US005315932A

United States Patent [19]

Bertram

[11] Patent Number: 5,315,932

[45] Date of Patent: May 31, 1994

[54] ENSNARING SHOT CARTRIDGE

[76] Inventor: Charles H. Bertram, P.O. Box 126, Honesdale, Pa. 18431

[21] Appl. No.: 66,249

[22] Filed: May 25, 1993

[51] Int. Cl.[5] ..... F42B 7/02

[52] U.S. Cl. ..... 102/457; 102/438; 102/439; 102/449; 102/504

[58] Field of Search ..... 102/371, 393, 400, 438, 102/439, 448, 449, 450, 451, 452, 453, 454, 455, 457, 459, 504, 506

[56] References Cited

U.S. PATENT DOCUMENTS

| | | | |
|---|---|---|---|
| 347,988 | 8/1886 | Boyd | 102/455 |
| 1,198,035 | 9/1916 | Huntington | 102/504 |
| 1,211,001 | 1/1917 | Steinmetz | 102/504 |
| 1,488,182 | 3/1924 | Whelton | 102/504 |
| 1,536,164 | 5/1925 | Tainton | 102/504 |
| 2,354,451 | 7/1944 | Forbes | 102/504 |
| 2,373,364 | 4/1945 | Wellcome | 102/504 |
| 3,085,510 | 4/1963 | Campbell | 102/457 |
| 4,559,737 | 12/1985 | Washington | 102/504 |
| 4,664,034 | 5/1987 | Christian | 102/457 |

FOREIGN PATENT DOCUMENTS

| | | | |
|---|---|---|---|
| 119316 | 10/1918 | United Kingdom | 102/504 |

*Primary Examiner*—Harold J. Tudor
*Attorney, Agent, or Firm*—Norman B. Rainer

[57] ABSTRACT

A shot cartridge is made to contain a projectile system for harmlessly ensnaring a fleeing person. The projectile system employs three or four buckshot paired with an equal number of twinned fish hooks. Each buckshot and fish hook pair is joined by a thin strong line, and all said lines are joined at a single site. The fish hooks are separately housed adjacent the rear of the cartridge. The buckshot are separately housed adjacent the front of the cartridge. The line is housed within the cartridge in a compacted state. When fired, the projectile system deploys with an assured wide pattern.

7 Claims, 1 Drawing Sheet

ENSNARING SHOT CARTRIDGE

BACKGROUND OF THE INVENTION

1. Field of the Invention

This invention concerns a shot cartridge, and more particularly relates to a shot cartridge which produces an ensnaring type projectile.

2. Description of the Prior Art

A shot cartridge for a barreled weapon may be characterized in general as a form of ammunition containing a rearwardly disposed charge of propellant and a multitude of projectiles disposed forwardly of said propellant. The projectiles are usually maintained in place by forwardly disposed closure means. When the cartridge is fired, as by a percussion primer cap, the expansive gaseous force generated by the propellant causes the projectiles to break through the closure means and thence travel as a group through the barrel toward the target. In view of the multitude of projectiles and their spread pattern once emergent from the barrel, the likelihood of hitting the target is greater than in the case of a rifle that fires a single projectile.

In law enforcement work, it is often necessary to stop a fleeing person while causing minimal harm. U.S. Pat. No. 4,559,737 to Washington discloses a firearm that fires two laterally separated tethered projectiles. The projectiles are intended to separate to a wide distance during flight, and are further intended to wrap around the legs of a fugitive in bolas fashion. Such action is intended to wrap the tether line about the legs of the fugitive, thereby entangling him and preventing escape.

In order for the Washington device to be effective, the projectiles must have significant weight, and this could be injurious. Also, the two projectiles may produce an unpredictable and inaccurate spread. For example, if one projectile has a higher velocity than the other, both travel in a straight line, producing essentially no spread pattern. Once wrapped around the legs of a person, it may be relatively easy for the person to unwind the tether line and continue his escape.

The use of munitions containing fettered or tethered shot is well known, as exemplified in U.S. Pat. Nos. 347,988; 1,198,035; 1,536,164; 2,373,364; 3,085,510 and 4,664,034. Such munitions are often found to experience tangling of the shot, or other malfunctions causing the pattern of the traveling shot to be unpredictable.

It is accordingly a primary object of the present invention to provide a shot shell capable of delivering a projectile that can entangle a person's legs without causing harm.

It is another object of this invention to provide a shot shell as in the foregoing object wherein said projectile is of an integral nature and deployed in a wide, predictable pattern.

It is a further object of the present invention to provide a shot shell of the aforesaid nature which functions in a reliable manner and can be used interchangeably with conventional shot shells in conventional shotguns.

These and other beneficial objects and advantages will be apparent from the following description.

SUMMARY OF THE INVENTION

The above and other beneficial objects and advantages are accomplished in accordance with the present invention by a projectile system incorporated into a shot shell having a cylindrical casing terminating in front and rear extremities, a base disposed at said rear extremity and having an axially centered percussion primer and enclosed charge of propellant, wadding disposed in sealing relationship forwardly of said propellant, and a closure panel associated with said front extremity, said projectile system being housed within said casing between said wadding and closure panel, and comprised of:

a) a receptacle liner of integral construction having a cylindrical sidewall portion configured to closely conform to the interior of said casing, a flat floor panel adapted to abut said wadding, and an open forward extremity, b) a rear friction fit retainer panel positioned within said liner forwardly adjacent said floor panel and defining therewith a rear storage space, c) a plurality of hooks separately stored within said rear storage space, d) a front friction fit retainer panel positioned within said liner adjacent said front extremity and defining with said closure panel a front storage space, e) a plurality of buckshot, corresponding to the number of hooks, stored within said front storage space, and f) a plurality of lengths of thin, strong line, each having a distal extremity that attaches to a buckshot, and an opposed proximal extremity, each line engaging a hook, all proximal extremities joining at a single site, said lines being confined in compacted state within said liner between said storage spaces.

In a preferred embodiment, radially arranged separator panels traverse the liner, forming longitudinal storage spaces separating each compacted line. Said plurality of buckshot is preferably three or four buckshot. The hooks are preferably fish hooks of very small size and preferably of twinned configuration.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
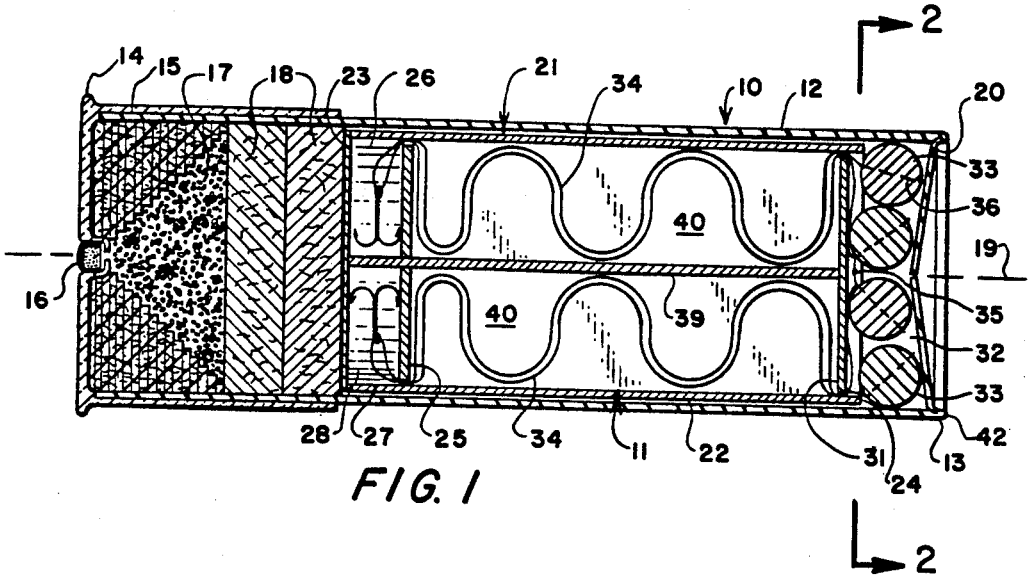
FIG. 1 is a longitudinal sectional view of an embodiment of the shot shell of the present invention.

Referring to FIGS. 1–4, an embodiment of a shot shell 10 is shown incorporating the projectile system 11 of the present invention.

Shot shell 10 may have features typical of a conventional 10 or 12 gauge shot gun shell. In particular, shot shell 10 is comprised of a circular cylindrical casing 12 having a center longitudinal axis 19, and terminating in front and rear extremities 13 and 14, respectively. The casing may be fabricated of plastic, cardboard, metal or composite plastic/film material. A metal base 15, disposed upon said rear extremity, holds an axially centered percussion primer cap 16, and encloses a charge of particulate propellant 17 which may be in powder, flake or granule form. For the purposes of the present invention, the propulsive power of the charge of propellant is reduced by 30% to 50% over the usual power employed for a conventional buckshot shotgun shell.

Wadding wafers 18 disposed within casing 12, serve to confine the particulate propellent. A closure panel 20 is secured to front extremity 13 of the casing by an inwardly crimped flange portion 42 of said casing.

The projectile system 11 of this invention is housed within casing 12 between wadding wafers 18 and closure panel 20. Said system is comprised of a receptacle liner 21 of integral construction, fabricated of cardboard or plastic and having a cylindrical sidewall portion 22 configured to closely conform to the interior of casing 12. A flat floor panel portion 23 of liner 21 abuts against the forward-most wadding wafer 18. The forward extremity 24 of liner 21 is of open construction.

A rear friction fit retainer panel 25 is positioned adjacent floor panel 23, and defines therewith a rear storage space 26.

Three or four hooks 27 are separately maintained within said rear storage space. Divider walls 28 emergent from floor panel 23 may be employed to maintain said hooks in a separated state. The hooks are preferably small sized fish hooks (#16 size), and are preferably double hooks wherein the shanks 29 of the hooks are joined, causing the hooks to lie in opposition in coplanar relationship. The hooks may have barbs 30 or may be barbless. It has been discovered that such double hooks are far superior to single hooks in accomplishing the objectives of this invention. The well known treble fish hooks are not useful in the practice of this invention because they cause tangling prior to impact on the target.

A front friction fit retainer panel 31 is positioned adjacent front extremity 13, and defines with closure panel 20 a front storage space 32.

Three or four buckshot 33, corresponding to the number of hooks in said rear storage space, are stored with in front storage space 32.

Figure 3:
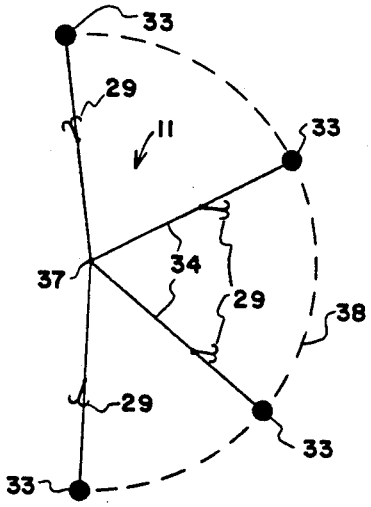
FIG. 3 is a schematic view of the deployed projectile system emergent from the shot shell of FIG. 1.
Figure 2:
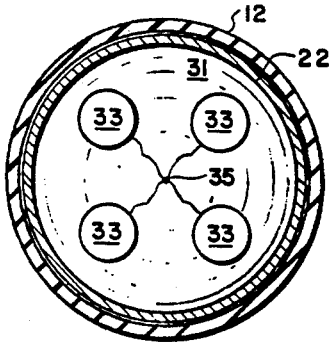
FIG. 2 is a transverse sectional view taken in the direction of the arrows upon the line 2—2 of FIG. 1.

A length of thin, strong line 34 such as 20 lb. test nylon monofilament fishing line joins each hook with a corresponding buckshot. Each length of line has a proximal extremity 35, and a distal extremity 36 that attaches to a buckshot. Each length of line engages a hook about midlength between said distal and proximal extremities. All proximal extremities are joined at a single apex site 37. By virtue of such arrangement, the pattern of the deployed projectile, as shown in FIG. 3, places the buckshot at the outer perimeter 38 in bolas fashion, while the hooks are disposed between said perimeter and apex site 37 which is centrally located.

Lines 34 are stored in a compacted state within liner 21. The compacted state may be a back-and-forth folded or randomly laid configuration, or a spirally wound array. The total length of each length of line may range between about 1 and 3 feet. In order to maintain the lengths of line separate in their storage state, separator panels 39 may be employed, forming longitudinal storage spaces 40. It is to be noted that a doubled length of each line extends through storage spaces 40, the reason being that both the distal and proximal extremities of each length of line is held within front storage space 32. Accordingly, in extending between front and rear storage spaces, each line is essentially a folded length wherein the hooks are attached at the midlength of the line.

Figure 4:
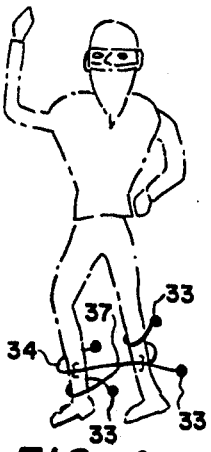
FIG. 4 is a schematic view illustrating the manner of function of the projectile system.
Figure 5:
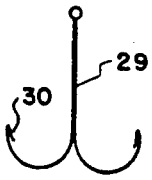
FIG. 5 is an enlarged plan view of a hook useful in the projectile system.

In operation, the firing of the propellant charge separates closure panel 20, and drives liner 21 with its contents through the barrel of the shotgun. Upon emergence from the barrel, the structural elements of the liner break apart, enabling the projectile system to assume the approximate configuration shown in FIG. 3. Upon impact with a person's legs, the buckshot wraps around the legs, as shown in FIG. 4, bringing the hooks into engagement with other portions of the line or with the person's trousers or skin. It has been found that, in the absence of the hooks, the buckshot and associated line is too easily removed.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. A projectile system incorporated into a shot shell having a cylindrical casing terminating in front and rear extremities, a base disposed at said rear extremity and having an axially centered percussion primer and enclosed charge of propellant, wadding disposed in sealing relationship forwardly of said propellant, and a closure panel associated with said front extremity, said projectile system being housed within said casing between said wadding and closure panel, and comprised of:

a) a receptacle liner of integral construction having a cylindrical sidewall portion configured to closely conform to the interior of said casing, a flat floor panel adapted to abut said wadding, and an open forward extremity, b) a rear friction fit retainer panel positioned within said liner forwardly adjacent said floor panel and defining therewith a rear storage space, c) a plurality of fish hooks separately stored within said rear storage space, d) a front friction fit retainer panel positioned within said liner adjacent said front extremity and defining with said closure panel a front storage space, e) a plurality of buckshot, corresponding to the number of fish hooks, stored within said front storage space, and f) a plurality of lengths of thin, strong line, each having a distal extremity that attaches to a buckshot, and an opposed proximal extremity, each line engaging a fish hook, all proximal extremities joining at a single site, said lines being confined in compacted state within said liner between said storage spaces.

2. The projectile system of claim 1 wherein radially arranged separator panels traverse the length of said liner between said front and rear retainer panels, forming longitudinal storage spaces which separately house each compacted line.

3. The projectile system of claim 1 wherein said plurality of buckshot is three buckshot.

4. The projectile system of claim 1 wherein said plurality of buckshot is four buckshot.

5. The projectile system of claim 1 wherein each of said fish hooks is of twinned configuration having two opposed hooks in coplanar disposition.

6. The projectile system of claim 1 wherein said fish hooks are attached to said lengths of line at a site on said line which is approximately midlength between the distal and proximal extremities of said line.

7. The projectile system of claim 6 wherein a doubled length of each line extends between said front and rear retainer panels.

* * * * *